United States Patent [19]

Malina

[11] 3,988,239

[45] Oct. 26, 1976

[54] CYCLONE AND LINE

[75] Inventor: Robert B. Malina, Pasadena, Tex.

[73] Assignee: Picenco International, Inc., Houston, Tex.

[22] Filed: Aug. 19, 1974

[21] Appl. No.: 498,545

[52] U.S. Cl. ..... 209/211; 220/63 R

[51] Int. Cl.[2] ..... B04C 5/085

[58] Field of Search ..... 209/144, 211; 175/206, 175/66; 210/512 R; 55/435; 220/63 R

[56] References Cited

UNITED STATES PATENTS

| | | | |
|---|---|---|---|
| 2,622,735 | 12/1952 | Criner | 209/211 |
| 2,995,255 | 8/1961 | Demeter | 210/512 R |
| 3,025,965 | 3/1962 | Bergman et al. | 209/211 X |
| 3,057,476 | 10/1962 | Gilbert | 209/211 |
| 3,136,723 | 6/1964 | Erwin et al. | 209/211 X |
| 3,902,601 | 9/1975 | Townley | 209/144 |

OTHER PUBLICATIONS

Bulletin No. 2503, "The fr Dorrclone," Dorr–Oliver, Inc., Stamford, Conn., 1955.

Sheet No. 2501–A, "24" Diameter Dorrclone for Sand Plant Applications", Dorr–Oliver, Inc., Stamford, Conn., 1956.

*Primary Examiner*—Frank W. Lutter
*Assistant Examiner*—Ralph J. Hill
*Attorney, Agent, or Firm*—Browning & Bushman

[57] ABSTRACT

The invention pertains to a liner for a cyclone comprising a body whose inner surface defines a longitudinal passageway through the body, the passageway including a conical section, the surface defining the passageway having a lesser wear portion and a greater wear portion. The liner body comprises a hollow bladder with an internal circumferential recess and a generally tubular insert disposed in the recess. The insert defines the greater wear portion of the passageway.

20 Claims, 6 Drawing Figures

FIG. 1
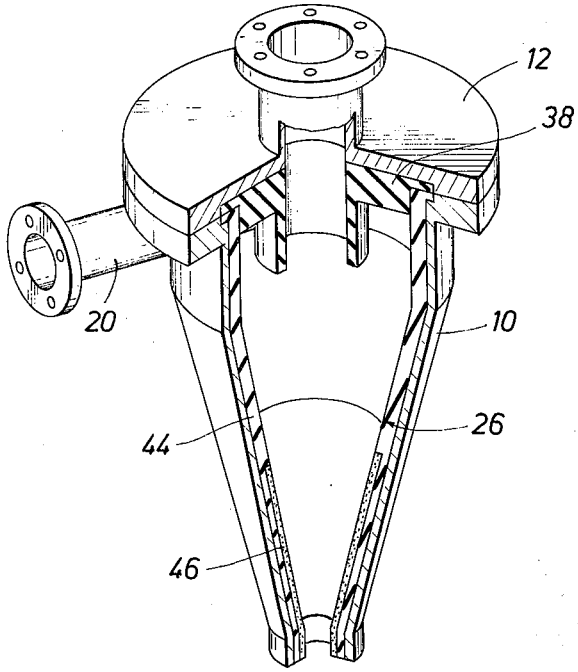
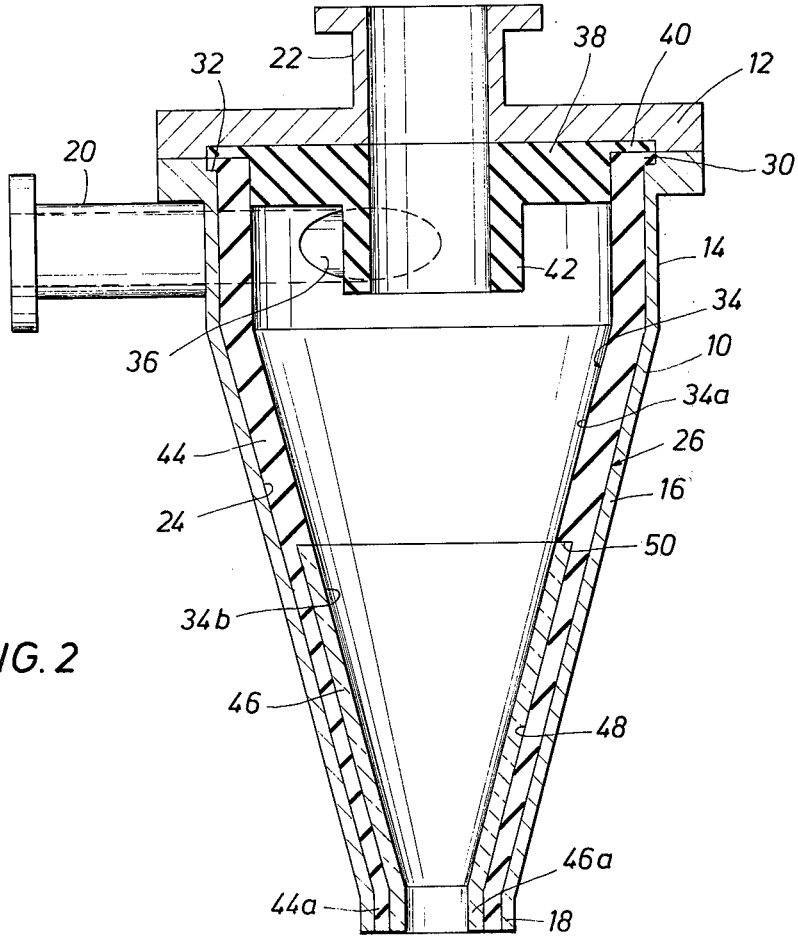
FIG. 2

CYCLONE AND LINE

BACKGROUND OF THE INVENTION

1. Field of the Invention

The invention relates to cyclonic separators and more specifically to cyclones for separating fluid containing mixtures.

A cyclone typically comprises a housing defining a chamber having an upper cylindrical section and a lower conical section with its large diameter portion adjacent the cylindrical section. The mixture to be separated is directed against the wall of the cylindrical section of the chamber in a horizontal, tangential direction by means of a tangentially disposed inlet communicating therewith. This results in the mixture flowing along the chamber wall in a downwardly spiraling path. The reduction in diameter downwardly along the chamber wall in the conical section causes angular acceleration of the flowing mixture. The heavier constituents of the mixture move radially outwardly toward the chamber wall under centrifugal force and continue spiraling down the wall, while the lighter constituents flow upwardly through a vortex formed centrally of the chamber. The light constituents are removed from the chamber through an outlet communicating with the upper end of the chamber, the heavy constituents being removed through an outlet communicating with the small diameter portion of the conical section at or near the lower end.

The mixtures which are handled in cyclones, particularly the heavier constituents, which usually are solids, which flow along the chamber walls, are often of an abrasive nature. Thus, their flow along the walls can cause considerable wear especially since they are moving rapidly and are forced against the walls, by centrifugal force. This wear is usually particularly pronounced at the smaller diameter portion of the conical section where the centrifugal force is highest and the heavy constituents, usually solids, are most concentrated.

2. Description of the Prior Art

Because of the wear problem caused by the materials handled in cyclones, it is customary to provide a replaceable liner in the chamber of the housing to protect the inner walls of the housing. Of course, it is most desirable that the liner be as highly wear resistant as possible under the operating conditions in which it will be used. One of the problems encountered in the use of such liners is the expense of replacing them when they become worn. Unfortunately, many of the highly wear resistant materials which would otherwise be preferred for use in liners are so expensive that they become impractical for that use. Many of these materials are also impractical for certain applications because of their physical characteristics. For example, in some cases it is necessary, or at least desirable, that the liner be somewhat flexible to facilitate insertion into the cyclone chamber. In such cases many of the best wear resistant materials for certain operating conditions, such as metals, hard synthetic resins, ceramics, glasses and tungsten carbide, are eliminated because of their rigidity. In other cases, a rigid liner is more appropriate, and relatively flexible materials, such as soft synthetic resins, can not be used. Furthermore, most liners are subjected to various types of shocks caused, for example, by vibrations of the cyclone, thermal shocks, mechanical impacts, etc. Thus, frangible materials such as glasses and ceramics, although they have excellent wear resistance characteristics under many operative conditions, can not ordinarily be used.

Thus, in the past, relatively inexpensive materials having certain physical characteristics have often been chosen for use in liners at the expense of high wear resistance characteristics.

Present attempts to solve this problem involve the use of liners having two separate parts disposed longitudinally adjacent each other. The cyclone housings may or may not also comprise two parts which are flange-fitted together or otherwise connected. The lower part of the liner is formed of a preferred wear resistant material, and the upper part of another material. Such designs are not satisfactory for many reasons. Because of the precision fits required between the two parts of the liner, between the two parts of the housing, and between the parts of the liner and the housing, cyclones and liners of this type are difficult and expensive to manufacture. Even at best, they are seldom properly fitted. Furthermore, where frangible materials are used in the liners, they are easily broken or damaged during installation and/or operation.

SUMMARY OF THE INVENTION

The present invention provides a liner for a cyclone comprising a body having an inner surface defining a longitudinal passageway through the body and generally corresponding, in shape, to the configuration of the housing chamber. The inner surface of the body which defines the passageway forms the working surface of the cyclone and has a lesser wear portion and a greater wear portion. In most instances, the lesser wear portion is located at the large diameter portion of the conical section of the passageway and the upper cylindrical section, if any, and the greater wear portion is located at the smaller diameter portion of the conical section.

The liner body is comprised of a hollow bladder having a longitudinal bore which corresponds generally to the passageway of the liner as a whole. The bladder has an internal circumferential recess for receiving a tubular insert. The inner surface of this insert thus forms the greater wear portion of the inner surface of the liner body while the bladder itself forms the lesser wear portion. The liner can be designed so that the insert is removable from the recess. Being located at the greater wear portion of the passageway, the insert may wear more rapidly than the bladder. However, if it is removable, it can be replaced without the expense of replacing the entire liner.

Whether or not it is removable from the recess, the insert can be formed of a desired wear resistant material and the bladder of another material, which might be less wear resistant than that of the insert but also less expensive and/or preferred because of its other physical properties.

This construction provides greater wear resistance in the area where it is critically needed without the undue expense of forming the entire liner of a highly wear resistant but expensive material and without the disadvantages of two longitudinally abutting parts. Additionally, it allows the bulk of the liner, including the large upper part to be made of a material having desired physical characteristics such as flexibility or rigidity. The insert then can often be made of a material which does not have these physical characteristics, and this broadens the selection of materials for the insert. Thus, the liner of the present invention provides the advantages of both types of material, while substantially eliminating the disadvantages of liners made exclusively of one type of material and of prior two-piece cyclones and liners.

If it is desired to use a frangible material for the wear resistant insert, a relatively compressible or shock absorbing material can be used in the bladder so that the bladder radially outwardly of the insert forms a protective backing between the insert and the housing.

Thus, a primary object of the present invention is to provide a cyclone liner in which the passageway is defined by a bladder at a lesser wear portion and by an insert disposed in the bladder at a greater wear portion.

Another object of the invention is to provide a cyclone liner comprising a bladder and a removable insert.

Another object of the invention is to provide a cyclone liner comprising a bladder of a relatively inexpensive material and a wear resistant insert disposed in an internal circumferential recess in said bladder.

Still another object of the invention is to provide a cyclone liner comprising a bladder of a first material having desired physical characteristics and a wear resistant insert having other physical characteristics.

Still another object of the invention is to provide a cyclone liner comprising a protective backing for a frangible wear resistant insert.

Yet another object of the invention is to provide a bladder for a cyclone liner adapted for receipt of a wear resistant insert.

Still other objects, features and advantages of the invention will be made apparent by the detailed description of the preferred embodiments, the drawings and the claims.

BRIEF DESCRIPTION OF THE DRAWINGS

FIG. 1 is a perspective view of a cyclone and liner according to the invention with part broken away.

FIG. 2 is a longitudinal sectional view on an enlarged scale of the cyclone of FIG. 1.

DESCRIPTION OF THE PREFERRED EMBODIMENTS

Figure 3:
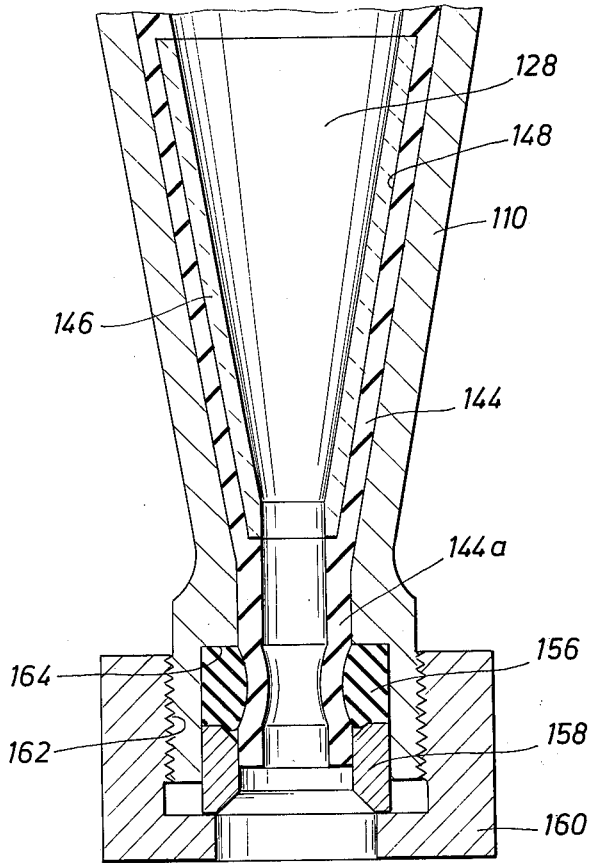
FIG. 3 is a longitudinal sectional view of the lower part of a cyclone and liner according to the invention showing a modification for varying the diameter of the lower outlet.

Referring to FIGS. 1 and 2 there is shown a cyclone having a housing comprised of a lower housing part 10 and a top cover 12. The lower housing part 10 includes a large diameter generally cylindrical upper section 14, and a lower generally conical section 16 having its larger diameter portion adjacent the cylindrical section 14. The chamber 24 defined by the housing, thus, has corresponding cylindrical and conical sections. It should be stated at this point that the upward and downward directions are mentioned with reference to the operation of the device with its axis vertical and the apex of the conical section at the bottom as shown in the embodiments depicted in the drawings. The device will, however, operate substantially with equal efficiency regardless of whether the cone points upwardly or downwardly or strictly horizontally. Gravity has substantially no effect upon the separating operation. Reference to the direction of movement of the streams and the relative disposition of the parts of the device is simply for convenience in explaining the operation. A pipe 20 disposed generally tangentially to the chamber communicates with the chamber 24 at cylindrical section 14 of the housing part 10 and serves as an inlet for the cyclone. A first outlet is provided by a tubular part 22 of the cover 12. A second outlet 18 is formed by a small diameter section of the lower housing part 10 adjacent the small diameter portion of the conical section 16. In the cyclone shown, both outlets 22 and 18 are coaxial with the chamber 24. However, it should be understood that this may vary and, in particular, that in some cyclones the lower outlet communicates tangentially with the small diameter portion of the conical section of the chamber.

A liner comprising a body 26 is disposed in the chamber 24. The liner body 26 is generally tubular in the sense that it has a longitudinal passageway 28 therethrough defined by its inner surface 34. The inner and outer diameters of the liner body parallel the configuration of the side walls of the chamber 24. Thus, the passageway 28 also includes an upper cylindrical section and adjoining conical section radially adjacent sections 14 and 16, respectively, of the lower housing part 10. It should be understood, however, that in some applications the liner and its passageway might have a conical section but no upper cylindrical section. Liner body 26 has an annular flange 30 extending radially outwardly at its upper end. Flange 30 rests in an annular groove 32 in the inner surface of the lower housing part 10 to position the liner body 26 in the housing. The open upper end of the liner body 26 is coaxial with first outlet 22, and the open lower end of liner body 26 is coaxial with second outlet 18. The liner has a third opening 36 which registers with the opening from inlet pipe 20 to the housing. In some cases the liner may have an integral tubular inlet piece which extends into the inlet pipe 20.

A vortex finder 38 is positioned at the top of the passageway 28 by means of a flange 40 which rests on the upper surface of the liner 26. The vortex finder 38 has a downwardly projecting nozzle 42, coaxial with outlet 22 for directing the lighter constituents to the outlet 22.

The liner body 26 is comprised of a hollow, generally tubular bladder 44 and a tubular insert 46. Bladder 44 has a longitudinal bore therethrough and both the bladder itself and its bore have upper generally cylindrical and lower generally conical sections corresponding to those of the housing and its chamber 24. The lower portion of the conical section of bladder 44 has an internal circumferential cavity or recess 48. Insert 46 is disposed in the recess 48. Thus, the inner surface 34 of the liner body is formed in part by the inner surface of the insert 46 and in part by the longitudinally adjacent portion of the inner surface of the bladder 44 upwardly of the recess 48.

The inner surface 34 of the liner body 26 defining the passageway 28 thus has an upper, large diameter portion **34*a* formed by bladder 44 and a lower, small diameter portion 34*b* formed by insert 46. The large diameter portion 34*a* comprises the surface defining the cylindrical section and the upper portion of the conical section of the passageway. This portion 34***a* is the lesser wear portion of the surface 34. Portion 34*b* comprises the surface defining the lower portion of the conical section of the passageway and is the greater wear portion of the surface 34. Even though high wear might be experienced in the upper cylindrical section near the opening 36, portion 34*a* will, in general, experience less wear than portion 34*b*. This is because the heavier constituents are more concentrated and the centrifugal force is greater in the lower portion of the conical section of the passageway above outlet 18 during operation of the cyclone. For this reason, portions 34*a* and 34*b* of surface 34 are referred to respectively as lesser and greater wear portions with reference to each other.

In many cases, wear is also relatively high in the lower or second outlet 18 through which the heavier constituents of the material being handled by the cyclone are removed. Thus, in the preferred embodiments of the invention, the liner extends into the outlet 18. In particular, the bladder 44 has a tubular extension 44*a* extending into outlet 18. Recess 48 also extends into outlet 18 and insert 46 has a tubular extension 46*a* extending into outlet 18 in recess 48.

The insert 46 is preferably made of a highly wear resistant material and the bladder 44 of a material having lesser wear resistant characteristics as compared to those of the insert.

The insert 46 can be made removable from the recess 48. Because it defines the greater wear portion of the passageway, the insert 46 may wear faster than the bladder. However, it can then be removed and replaced without replacing the entire liner. Although the bladder 44 and insert 46 may be comprised of the same material, the insert 46 is preferably made of a highly wear resistant material. The bladder 44 can then be made of a material having lesser wear resistant characteristics than those of the insert but other desirable features. It should be understood that the term "wear resistant" is used herein with reference to the operating conditions which a given cyclone will experience. The composition of the material being handled as well as various environmental factors such as temperature will affect the choice of a suitable wear resistant material for the insert in a given set of operating conditions. A material which might prove highly wear resistant under one set of operating conditions might be relatively easily worn under other conditions.

For example, in many applications the preferred wear resistant materials are relatively hard or rigid materials such as glasses, ceramics, metals, refractories such as tungsten carbide, and synthetic polymeric materials such as hard polyurethanes, polycarbonates, and phenolics. In other applications, relatively soft materials may be preferred, their flexibility actually making them more wear resistant under these particular conditions. Examples of such soft materials might typically include soft polymeric materials such as polyurethanes or elastomers such as natural or synthetic rubbers. However, it should be understood that a "wear resistant" material in the sense that the term is used herein could include virtually any material as long as it is wear resistant under the operating conditions in question.

Any number of materials may be used in fabricating the bladder. However, it will usually be desirable to choose a relatively inexpensive one. Then, since the bulk of the liner is made up of the bladder, the liner as a whole is relatively inexpensive. In many cases, the material for the bladder preferably has certain physical characteristics. For example, when the liner has an integral inlet piece designed to extend into inlet pipe 20, a flexible material is desired to facilitate insertion of the liner into the housing chamber. In such instances, flexibility is usually especially needed in the large upper part of the liner. For such applications, a natural or synthetic elastomer might be used. The insert might also be flexible. However, in many cases, the elastomeric bladder will provide sufficient flexibility so that either rigid or flexible inserts can be used.

In some instances, a rigid liner is desirable. Here a rigid material such as a hard synthetic polymer might be chosen for the bladder. This would provide sufficient rigidity in the liner as a whole that a soft or flexible material could be used for the insert if desired. A flexible insert may, in fact, be preferred for use with a rigid bladder so that it could be easily installed in and removed from the recess.

Obviously, many combinations of materials can be employed. The important point is that the relatively small insert can be made of a highly wear resistant material, while the bladder, which makes up the bulk of the liner, can be made of a less wear resistant material, but one which has other desirable characteristics such as low cost or certain physical properties.

Several examples are illustrated in the drawings. In FIGS. 1–3 are shown liners in which the bladders 44 and 144 are elastomeric and the inserts 46 and 146 are comprised of glass or ceramic. It should be noted that the construction of the liner of the invention provides a particular advantage with this combination of materials since the bladder radially outwardly of the insert 46 forms a protective backing for the insert to prevent the insert from being broken during installation or by vibration of the housing, thermal or other shock, mechanical impact, etc., during operation. Thus, where the bladder is formed of a relatively compressible material such as an elastomer, the insert can be made of a frangible or brittle material, i.e. one having generally low ductility and malleability, such as glass.

Figure 4:
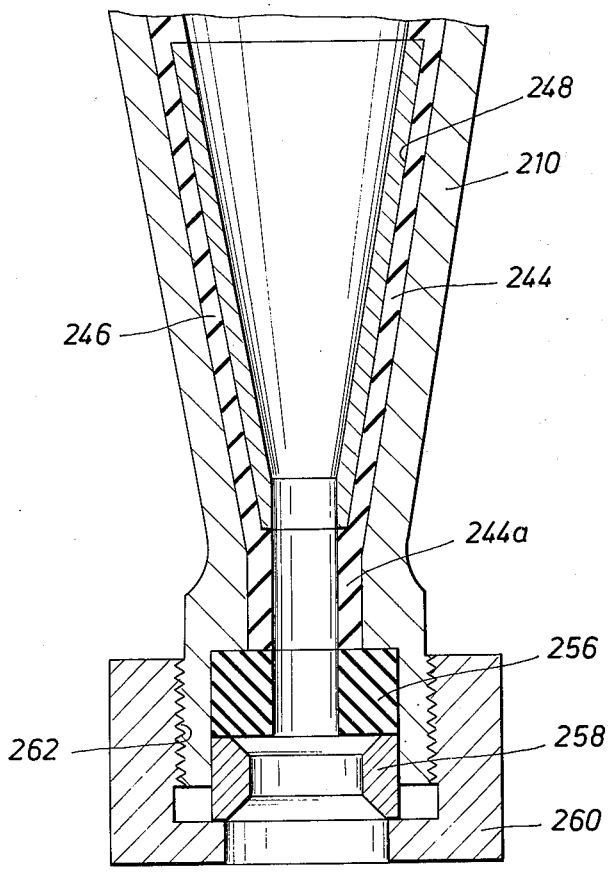
FIG. 4 is a view similar to that of FIG. 3 showing a second modification for varying the diameter of the lower outlet.
Figure 5:
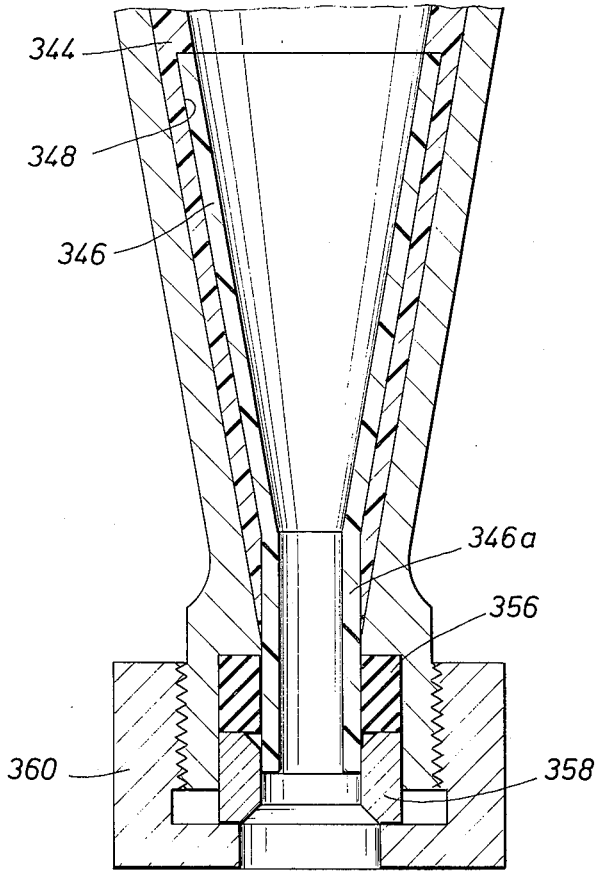
FIG. 5 is a view similar to that of FIG. 3 showing a third modification for varying the diameter of the lower outlet.
Figure 6:
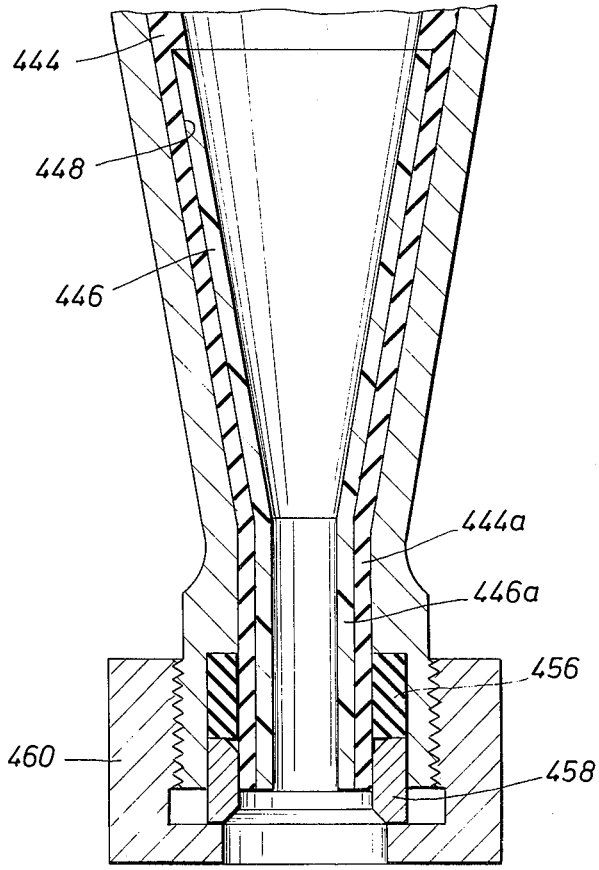
FIG. 6 is a view similar to that of FIG. 3 showing a fourth modification for varying the diameter of the lower outlet.

FIG. 4 shows a liner having an elastomeric bladder 244 and a metal insert 246. FIG. 5 shows a bladder 344 of hard polyurethane and an insert 346 of soft polymeric material. FIG. 6 shows an elastomeric bladder 444 and a soft polymeric insert 446.

The liner may be fabricated in several different ways. In a preferred method, the bladder is molded with the recess 48. The insert 46 is formed separately and then installed in the recess 48 from the upper end of the bladder 44. The upper shoulder 50 of the recess retains the insert against slipping upwardly in the bladder 44, and, of course, the tapered side surfaces of the insert and recess prevent the insert from slipping downwardly. When the liner body 26 is fabricated in this manner, the insert 46 can be easily removed and replaced when necessary without the need for replacing the entire liner. Another method of fabricating the liner of the invention is to mold the insert 46 into the bladder 44 during formation of the latter. Still other methods may be employed, particularly if the liner is modified slightly from the form shown in the drawings. In any case, the liner will be formed so that the insert defines the greater wear portion of the passageway through the liner.

In many instances it is desirable to vary the diameter of the second or lower outlet of a cyclone. FIGS. 3 and 4 show two modifications for accomplishing this with a liner having a wear resistant insert. Referring to FIG. 3, it will be seen that there is an insert 146 disposed in recess 148 in bladder 144. The tubular extension 144*a* of the flexible bladder 144 extends downwardly beyond the insert 146. Surrounding the extension 144*a* of the bladder 144 radially adjacent thereto and coaxial with the outlet is a deformable annulus 156 of elastomeric material. A washer 158 of metal or other rigid material, also coaxial with the outlet, is located just below annulus 156 in abutment therewith. The annulus 156 and washer 158 are held in place by an adjustable nut 160 threaded onto the housing 110 at 162. To reduce the diameter of the outlet, nut 160 is moved upwardly on its threads. Washer 158 will move upwardly with the nut 160. The annulus 156 cannot move upwardly because its upper surface is engaged by a shoulder 164 in the housing. Thus, the washer 158 longitudinally compresses the annulus 156 and causes the elastomeric material of the annulus to flow into the opening of the annulus. This, in turn, forces the flexible extension 144*a* radially inwardly reducing the size of the outlet.

A similar arrangement is shown in FIG. 4. Insert 246 is disposed in a recess 248 in bladder 244. In this embodiment, however, the extension 244*a* of bladder 244 does not extend through the annulus 256 but stops just above it so that the underflow flows directly through the annulus. Nor does the insert extend into the annulus. Again, the diameter can be varied by moving the adjustable retaining nut 260 to cause more or less longitudinal pressure on the annulus 256 by the washer 258.

In the liner shown in FIG. 5, a flexible insert 346 is disposed in the recess 348 in a rigid bladder 344. In this embodiment, the insert 346 has a tubular extension 346*a* which extends downwardly beyond the lower edge of the bladder 344 and through the deformable annulus 356. Variation of the diameter of the outlet is again accomplished by means of a washer 358 longitudinally abutting the annulus and a nut 360 for raising and lowering the washer 358 as in FIG. 1. However, in this case the flexible part of the liner which extends through the annulus 356 is an extension of the insert 346 rather than of the bladder 344 which is rigid.

In the embodiment shown in FIG. 6 both the bladder 444 and the insert 446 disposed in the recess 448 are flexible. The bladder 444 and insert 446 have respective coaxial tubular extensions 444*a* and 446*a* both of which extend through the deformable annulus 456. Once again, variation of the diameter is accomplished by raising and lowering a nut 460 and a washer 458 to longitudinally compress or release the annulus 456.

It will be appreciated that many modifications of the invention are possible, and it is, thus, intended that the scope of the invention be limited only by the claims.

I claim:

1. A liner for a cyclone comprising a body having a surface defining a longitudinal passageway through said body, said passageway including a generally conical section, said surface defining said passageway having a lesser wear portion and a greater wear portion, said liner body comprising a hollow bladder having an internal circumferential recess therein, and a generally tubular insert disposed in said recess and defining said greater wear portion of said surface, said recess and said insert having engaged side surfaces, said side surfaces having diameters decreasing in a direction extending longitudinally away from the larger end of the conical section of said passageway and toward the smaller end of the conical section of said passageway whereby said insert is restrained against longitudinal movement with respect to said bladder in the direction of decrease of said diameters.

2. A liner according to claim 1 wherein said greater wear portion is located generally in the smaller diameter portion of said conical section.

3. A liner according to claim 1 wherein said insert is removable from said recess.

4. A liner according to claim 3 wherein said bladder and said insert are comprised of the same material.

5. A liner according to claim 1 wherein said passageway further includes a generally cylindrical section adjacent the larger diameter portion of said conical section.

6. A liner according to claim 1 wherein said bladder is formed of a first material and said insert is formed of a second material, said second material having greater wear resistance characteristics than said first material.

7. A liner according to claim 6 wherein said second material is relatively frangible and said first material is relatively compressible whereby said bladder radially outwardly of said insert forms a protective backing for said insert.

8. A liner according to claim 6 wherein said first material is relatively rigid and said second material is flexible.

9. A liner according to claim 6 wherein said first material is flexible and said second material is relatively rigid.

10. In a cyclone comprising a housing defining a chamber, said chamber having a generally conical section, said housing also having an inlet, a first outlet, and a second outlet: a liner disposed within said chamber, said liner comprising a body having a surface defining a longitudinal passageway through said body said passageway including a generally conical section radially adjacent said conical section of said chamber, said surface defining said passageway having a lesser wear portion and a greater wear portion, said liner body comprising a hollow bladder, said bladder having an internal circumferential recess therein, and a generally tubular insert disposed in said recess and defining said greater wear portion of said surface, said recess and said insert having engaged side surfaces, said side surfaces having diameters decreasing in a direction extending longitudinally away from the larger end of the conical section of said passageway whereby said insert is restrained against longitudinal movement with respect to said bladder in the direction of decrease of said diameters, said liner also having a first opening coaxial with said first outlet, a second opening coaxial with said second outlet, and a third opening registering with said inlet.

11. A cyclone according to claim 10 wherein said bladder is formed of a first material and said insert is formed of a second material, said second material having greater wear resistance characteristics than said first material.

12. A cyclone according to claim 11 wherein said second material is relatively frangible and said first material is relatively compressible whereby said bladder radially outwardly of said insert forms a protective backing for said insert.

13. A cyclone according to claim 10 wherein said greater wear portion is located in the smaller diameter portion of said conical section of said passageway.

14. A cyclone according to claim 10 wherein said second outlet is located in the smaller diameter portion of said conical section, said cyclone further including means adjacent said second outlet for varying the diameter of said second outlet.

15. A cyclone according to claim 14 wherein said means for varying the diameter of said second outlet includes an annulus of deformable material adjacent to and coaxial with said second outlet, and means for longitudinally compressing said annulus to cause said deformable material to flow into the opening of said annulus.

16. A cyclone according to claim 15 wherein said annulus is disposed axially adjacent said second opening of said liner.

17. A cyclone according to claim 15 wherein said liner has a tubular extension coaxial with said second opening, said extension including a flexible part, and said annulus surrounding said part.

18. A cyclone according to claim 17 wherein said extension of said liner comprises a tubular extension of said bladder.

19. A cyclone according to claim 17 wherein said extension of said liner comprises a tubular extension of said insert.

20. A cyclone according to claim 17 wherein said extension of said liner comprises coaxial tubular extensions of said bladder and said insert.

* * * * *

UNITED STATES PATENT OFFICE

CERTIFICATE OF CORRECTION

Patent No. 3,988,239 Dated October 26, 1976

Inventor(s) Robert B. Malina

It is certified that error appears in the above-identified patent and that said Letters Patent are hereby corrected as shown below:

In Column 8, Claim 11, line 55,please insert after the word "said" for"inser" read --insert is--.

Signed and Sealed this

Fifth Day of April 1977

[SEAL]

*Attest:*

RUTH C. MASON
*Attesting Officer*

C. MARSHALL DANN
*Commissioner of Patents and Trademarks*